United States Patent [19]

Govan

[11] Patent Number: 4,801,281

[45] Date of Patent: Jan. 31, 1989

[54] LINE CUTTER FOR OUTBOARD, INBOARD/OUTBOARD, AND TROLLING MOTORS

[76] Inventor: Donald T. Govan, P.O. Box 350246, Ft. Lauderdale, Fla. 33335

[21] Appl. No.: 907,195

[22] Filed: Sep. 12, 1986

[51] Int. Cl.[4] ..... B63H 5/16

[52] U.S. Cl. ..... 440/73; 416/146 R; 440/49

[58] Field of Search ..... 440/49, 73, 76, 78, 440/79, 81, 89, 900; 416/245 A, 146 R, 90 A, 93 A, 93 R, 13, 14; 16/86 A, 86 R; 296/207; 267/63 R, 139, 140, 152, 153

[56] References Cited

U.S. PATENT DOCUMENTS

| | | | |
|---|---|---|---|
| 1,978,249 | 10/1934 | Decarie | 16/86 R |
| 2,696,797 | 12/1954 | Whidden | 440/14 |
| 3,915,417 | 10/1975 | Norton et al. | 440/900 |
| 4,080,099 | 3/1978 | Snyder | 416/146 B |
| 4,507,091 | 3/1985 | Govan | 440/73 |

*Primary Examiner*—Joseph F. Peters, Jr.
*Assistant Examiner*—Ed Swinehart
*Attorney, Agent, or Firm*—Dale P. DiMaggio

[57] ABSTRACT

A device mounted in encircling relation to a propeller shaft. The device cuts lines, nets and weeds, thus preventing entanglement of the propeller and preventing entanglement damage which may result to the parts of the driven assembly of the outboard, inboard/outboard or trolling motor used to propel vessels through the water. The device includes a non-rotatable, annular cutting ring member having one or more double-edged cutting blades, that is disposed in sandwiched relation to two rotatable annular members. One of the rotatable members carries no cutting blades, and the second rotatable member carries a plurality of double-edged, circumferentially spaced blades that individually cooperate with the non-rotatable blade in a shearing action. The non-rotatable member includes a protruding, forwardly expanding, wedge member, the wedge member being configured to define a forwardly opening wedge-shaped cavity. The protruding wedge members cavity enters into abutting engagement with the propeller shaft housing attendant rotation of the propeller shaft, the propeller shaft housing entering into fine engagement with the forwardly opening wedge-shaped cavity substantially instantaneously upon the introduction of a load on the apparatus.

26 Claims, 5 Drawing Sheets

LINE CUTTER FOR OUTBOARD, INBOARD/OUTBOARD, AND TROLLING MOTORS

BACKGROUND OF THE INVENTION

1. Field of the Invention

This invention relates to devices that cut lines, nets and weeds from the propellers of vessels, and more particularly relates to a device having utility in outboard motor, inboard/outboard motors, and trolling motor applications.

2. Description of Prior Art

The inventor of the subject invention has been awarded U.S. Pat. Nos. 4,447,215, 4,507,091, as well as 4,544,363 for propeller protecting devices. Applicant herein incorporates by reference the teachings of these U.S. Letters Patents. These devices represent the prior art containing the teachings most relevant to the subject invention. However the U.S. Pat. Nos. '215 and '091 have application in the environment of inboard motors, whereas the present invention has utility in the environment of outboard, inboard/outboard, and trolling motor applications. The earlier inventions and the present invention share the same principle of operation, however.

Lines, nets and weeds, are commonly encountered by vessels. Unfortunately, they are invariably swept by the propeller blades into the very part of the propeller assembly where they can do the most harm, i.e., where the propeller cowling meets the lower housing from which extends the propeller shaft. Lines enter the space between the cowling and the lower housing and wrap around the oil seals therein until they cut through such seals. This results in oil leakage into the water and of course requires the installation of new oil seals.

A device is needed that will prevent lines, nets and weeds from entering into any space where they can cause environment pollution and expensive-to-repair damage. The needed device would cut the lines as they are fed by the propeller blades to the cutting station.

SUMMARY OF THE INVENTION

The need for a propeller protecting device capable of cutting objects, such as lines, nets, weeds, and the like, that commonly follow outboard, inboard/outboard, or trolling motor propellers, is fulfilled by a device having four (4) primary components, namely (1) a rotatable ring shaped member having no cutting blades formed thereon, (2) a rotatable ring member having a plurality of circumferentially spaced blades formed thereon, (3) a substantially non-rotatable ring member having a single cutting blade formed thereon, which third member is positioned between the other two members, and which cutting blade has a forwardly extending portion, (4) a forwardly protruding, wedge member which is configured to define a forwardly opening wedge-shaped cavity, the wedge-shaped cavity adapted to receive a segment of the propeller shaft housing. Of the four (4) primary components one component in particular, the protruding, forwardly expanding, wedge-shaped member is of a unique design.

In the prior art, it has been required that the motor upon which the apparatus is designed to operate in conjunction with, i.e., the outboard, inboard/outboard and trolling motors, required the mounting of a "keeper bracket" to the actual motor housing. This entailed and required altering the motor by drilling the required holes therein and bolting or otherwise securing the keeper bracket directly to an external surface of the motor.

Altering the motor has its disadvantages in that boat owners are uncomfortable with drilling holes and possibly otherwise damaging the commercial product.

Therefore, this invention represents an improvement over the prior art, and allows one to purchase the line cutting apparatus and install it on a propeller shaft housing without requiring the altering, drilling of holes, or other securing of components to the motor itself. This invention can accomplish the above through the features of the improved, non-rotatable cutter ring assembly.

The non-rotatable cutter ring contains a protruding, forwardly expanding, wedge-shaped member which defines a forwardly opening wedge-shaped cavity. This wedge-shaped cavity is dimensioned to receive the propeller shaft housing. More specifically, the cavity receives the strut of the outboard, inboard/outboard, or trolling motor. The entire line cutting apparatus is mounted about the motor shaft which drives the propeller and does not require mounting of any other structure on the motor itself. This eliminates the necessity of drilling holes, utilizing adhesives, or otherwise altering the boat motor in a manner as heretofore required.

It is therefore an object of this invention to provide a line, net and weed cutter for use in conjunction with outboard, inboard/outboard, or trolling motors, with an assembly that is easy to install, and that will sit squarely relative to the propeller shaft and hub.

It is also an object of the invention to provide a line, net and weed cutter for use with outboard, inboard/outboard, and trolling motors which is cost effective yet operationally efficient.

It is also an object of this invention to provide a line, net and weed cutter for use with outboard, inboard/outboard, or trolling motors which does not require the drilling of holes, use of securing adhesives, or alterations of the motor or propeller shaft housing itself.

It is also an object of the invention to provide a line, net and weed cutter for use with outboard, inboard/outboard, or trolling motors which is adaptable for use with any of a great variety of motors, easy to manufacture therewith, and easy to install thereon.

It is finally an object of the invention to provide a line, net and weed cutter for use on outboard, inboard/outboard, or trolling motors, which is adapted for use with a variety of drive means, such that the line cutting apparatus can be driven by either the propeller shaft or the propeller itself.

This invention accordingly comprises the features of construction, combination of elements and arrangement of parts that will be exemplified in the construction hereinafter set forth, and the scope of the invention will be indicated in the claims.

BRIEF DESCRIPTION OF THE DRAWINGS

The above mentioned and other features and objects of this invention and the manner of attaining them will become more apparent and the invention itself will be best understood by reference to the following description of an embodiment of the invention taken in conjunction with the accompanying drawings, wherein:

FIG. 7 is an alternative embodiment of the invention illustrating a plurality of alternative cutting edges used in the invention.

Similar reference numerals refer to similar parts throughout the several views of the drawings.

DETAILED DESCRIPTION OF THE SPECIFIC EMBODIMENT

Throughout this description, the terms "forward" and "rearward" shall refer to the left and right, respectively, of all Figures.

Figure 1:
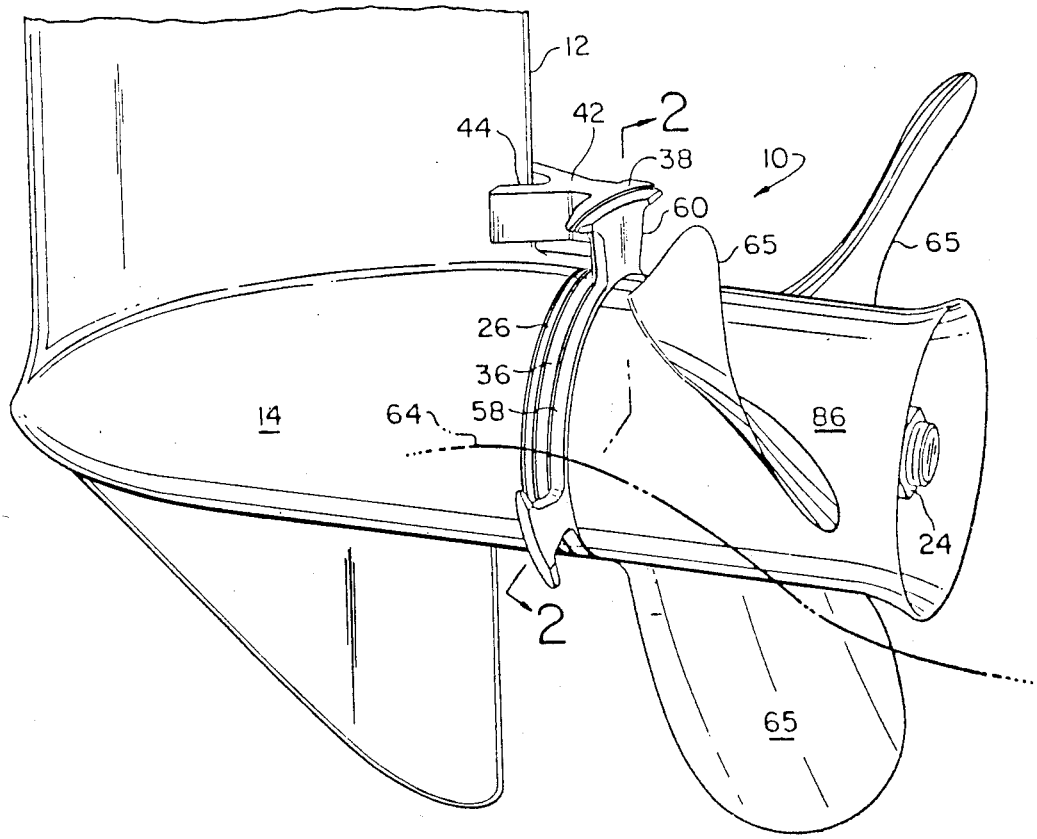
FIG. 1 is a perspective view that shows the assembly of this invention installed on an outboard or an inboard/outboard motor assembly.

Referring briefly to FIG. 1, it will there be seen that the invention in its assembled configuration and operative placement is indicated by the reference numeral 10 as a whole.

Figure 4:
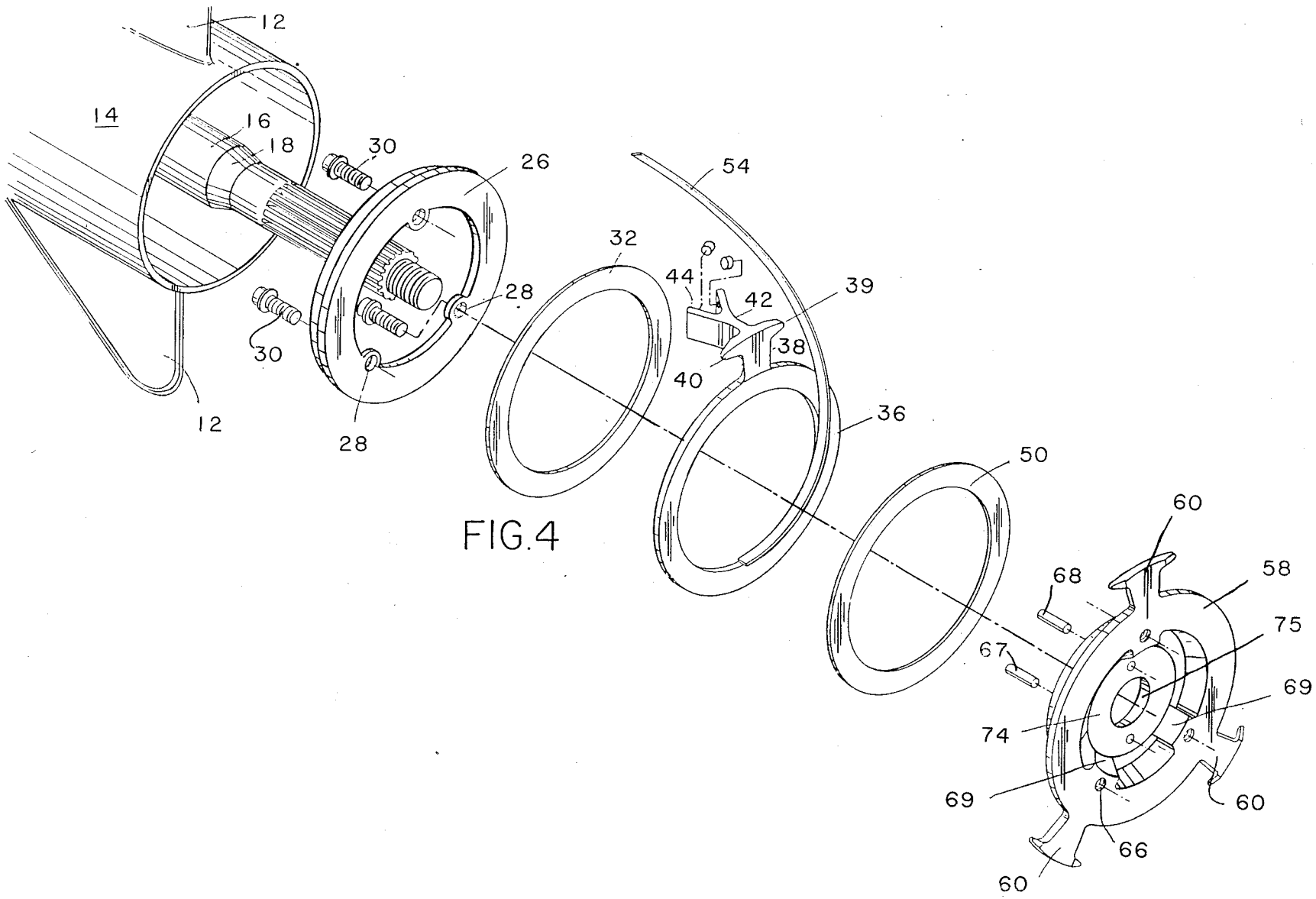
FIG. 4 is an exploded isometric view of the subject of the invention as installed on an outboard or inboard/-outboard motor assembly.

The lower end of the motor assembly 12 depends to the hull or keel of a boat, not shown. The strut 12 has a propeller shaft housing 14 that terminates in a circular opening that is best shown in FIG. 4. Still referring to FIG. 4, propeller shaft 16 having its axis of rotation at the center of the housing 14 is shown, and is seen to have an annular taper 18 formed therein. The taper 18 reduces the diameter of shaft 16 as illustrated, and a large portion of the reduced diameter shaft is female splined as at 20 in FIG. 2, said female spline engaging a corresponding male spline formed in the inner propeller hub 22. A commercial embodiment of the propeller hub is formed of rubber to protect the motor assembly when the propeller strikes rocks and other hard objects, and is known as a rubber cushioned hub. The rubber is depicted in FIG. 2 by very bold lines and surrounds the inner propeller hub 22.

Figure 2:
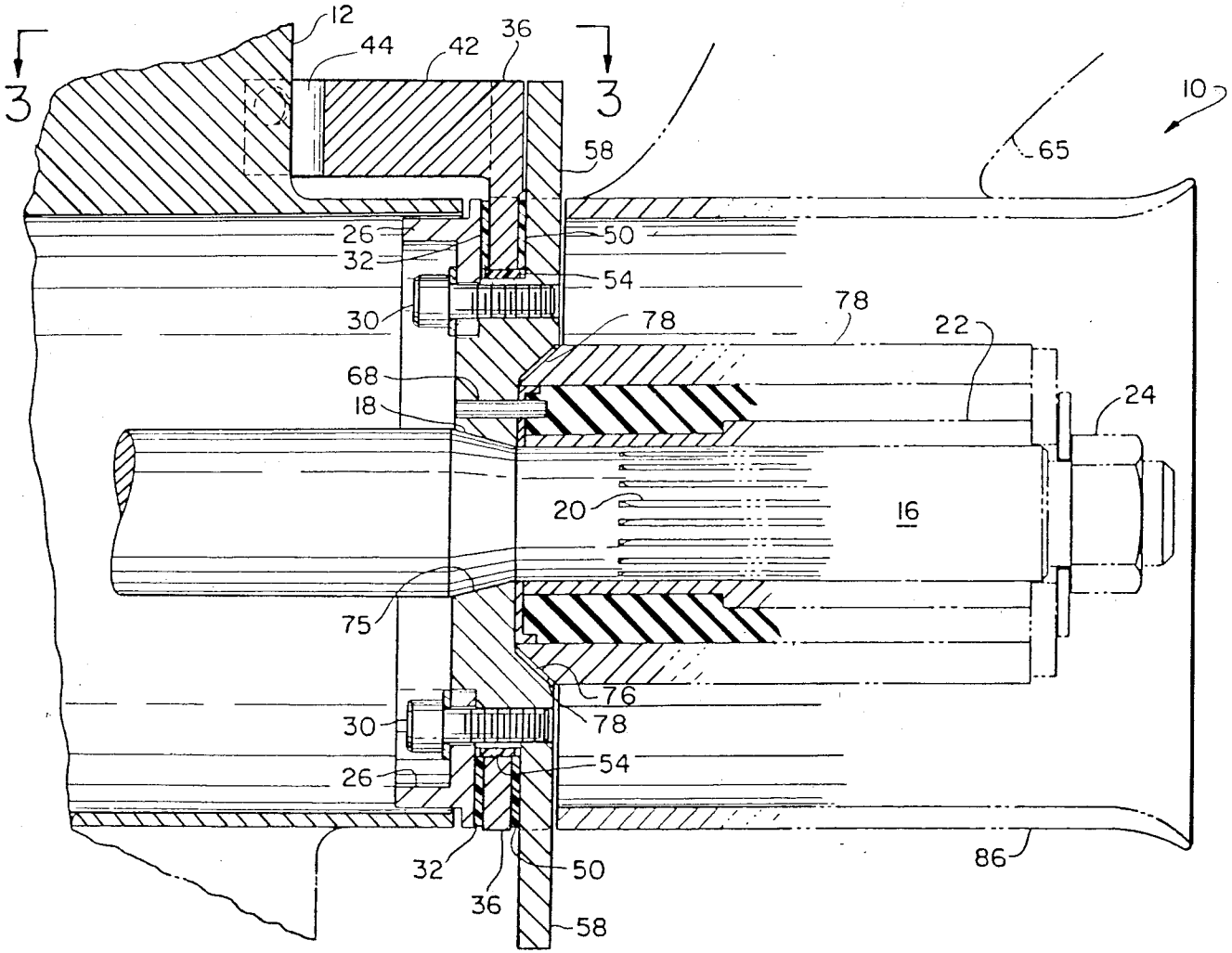
FIG. 2 is a sectional view taken along line 2—2 of FIG. 1.

The distal or rearward end of shaft 16 is threaded as shown to receive a mount nut 24, which is also shown in FIG. 2. The inventive assembly lengthens the propeller approximately by one inch (1"). To compensate for this additional length, one inch (1") of the forward facing surface of the propeller hub is removed by cutting. The vertical line immediately to the left of the reference numeral 20 in FIG. 2 is the cutting line, and the annular surface defined thereby will be referred to as the abutment surface. With this modification to the propeller, the assembly will fit entirely within cowling 86 as desired, as shown in both FIGS. 1 and 2.

A bolt ring 26 (FIG. 4) includes a plurality of circumferentially spaced aperture defining members 28 through which extend bolt members collectively designated 30. As will become clear as this description proceeds, the bolts 30 unite the bolt ring 26 and the rotatable cutter ring so that they rotate jointly.

A first bearing means 32 is disposed between bolt ring 26 and non-rotatable cutter ring 36. The bearing means 32 can be secured by any suitable means, such as mastic to bolt ring 26 or non-rotatable cutter ring 36. Similarly, bearing means 32 could be positioned in any acceptable manner therebetween. Bearing means 32 can be manufactured from any of a variety of materials as will be apparent to one skilled in the art. In particular embodiments, bearing means is manufactured of ceramic or alumina ceramic material.

Cutter ring 36 has a single double-edged blade member 38 integrally formed therewith. Blade member 38, in an alternative embodiment, has ramp like portions 39 and 40 extending therefrom. It should be noted that the ramp-like portions are mentioned for alternative designs, and are not required to practice the invention described herein. The function of the ramp is more fully described in the prior art references mentioned above.

A protruding, forwardly expanding, wedge member 42 is integrally formed on non-rotatable cutter ring 36. Wedge member 42 is configured to define a forwardly opening wedge-shaped cavity 44 which is adapted to receive the propeller shaft housing. Specifically, wedge-shaped cavity 44 receives a portion of strut 12 on propeller assembly housing 14. Cavity 44 communicating with strut 12 is more fully shown in FIGS. 1, 2 and 3, in an assembled configuration. It will be noted, as an improvement over prior art, that the wedge member cavity 44 allows the instant invention to be practiced without requiring the drilling of holes, or other alterations on the propeller housing assembly itself, as was described by the prior art references. In this manner, cavity 44 is placed about the strut 12 and is merely held in place, and prevents rotation of cutter ring 36, through the respective geometries. The strut acts as a competing force and acts in an interlocking manner, within cavity 44, to prevent rotation of cutter ring 36. The new geometry of the protruding, forwardly expanding, wedge member 42 allows for the elimination of the "keeper bracket" or other equivalent structure, as was previously required in the prior art.

The interaction of the protruding, wedge member 42, and the strut 12 is more fully described hereinafter.

A second bearing means 50 is interposed non-rotatable cutter ring 36 and rotatable cutter ring 58. The function and material of second bearing means 50 is similar to that described above in reference to first bearing means 32.

Rotatable cutter ring 58 carries a plurality of double-edged blade members 60. Blade members 60 cooperate with blade member 38 of non-rotatable cutter ring 36 to shear lines, nets or weeds that are encountered by the boat's propeller. The elongated dotted line represented by 64 in FIG. 1 represents a typical line or weed that could entangle and disable a propeller in the absence of the subject device. The blades 65 of the propeller perform a sweeping action that presents a line 64 to the blades 38 and 60 so that the line, net or weed could be sheared.

Referring again to FIG. 4, internally threaded bores 66 are formed in the cutter ring 58 in order to receive bolts 30 such that the elements 26, 36 and 58 form a unit. The large nut 24, mentioned earlier in conjunction with FIG. 1 and FIG. 2 retains the assembled device on propeller shaft 16. Locator pins 67 and 68 position the cutter ring 58 and its blade 60 relative to the propeller blades. In this manner, the blades 60 will be properly positioned relative to the propeller blades. As shown in FIG. 2, locator pins extend through rotatable cutter ring 58 and into the propeller hub 78. Thus, where a very thick cable or other non-shearable obstruction is encountered, the pins 67, 68 will shear off at the abutment surface so that the drive assembly of the vessel will not be subjected to damage.

It is to be clearly understood, that one or more drive pins would be sufficient to perform the above function, and the particular number of drive pins desired, or the particular location is not relevant to practicing the invention. As illustrated in FIG. 4, the pins 67 and 68 provide the drive means whereupon the rotation of the propeller will impart a concomitant rotation of the inventive cutter assembly.

In alternative embodiments, as described more fully hereinafter, the particular drive means which is utilized to impart rotation to the inventive cutter assembly, can either be driven by the propeller, or in the alternative, the propeller shaft. The particular manner of the drive means is not critical, and numerous variations will readily occur to those skilled in the art.

Cutter ring 58 includes radial legs 69 and a central aperture 75 of inner ring 74. The construction, function and use of the cutter ring 58 is fully described in the prior art patents mentioned above.

Figure 3:
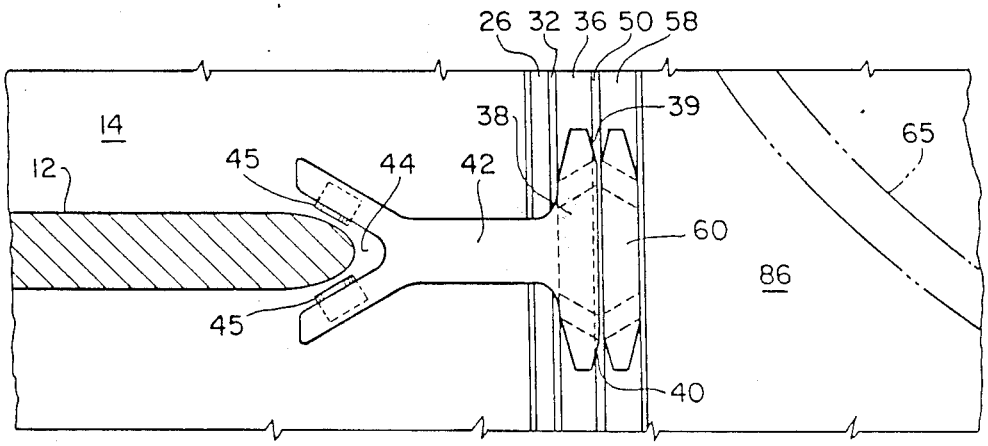
FIG. 3 is a partial plan view taken along line 3—3 of FIG. 2.

Referring now to FIGS. 1 and 3, it is there shown how the substantially non-rotatable cutter ring 36 is maintained against rotation by the interaction of strut 12 with forwardly opening wedge-shaped cavity 44 of protruding, forwardly expanding, wedge member 42. When a ship equipped with device 10 is underway in a forward direction the cutter rings 36 and 58 will begin rotation with propeller shaft 16 or propeller 86, depending upon the particular drive means utilized. This will result in an initial displacement of blades 38 and 60 in an upward direction toward the top of the page upon which FIG. 3 appears. When the propeller is operated in its reverse mode, the initial displacement of blades 38 and 60 will be toward the bottom of the page. In either event, the rotating ring 58 will continue its rotation as its path of travel will be unimpeded. Protruding wedge member 42, however, will rotate until its cavity 44 impinges against boat strut 12. The direction of the impediment depends upon the rotation of the direction of the propeller, of course, and accordingly, non-rotatable cutter ring 36 will rotate no further. Thus, at the instant a load is placed on assembly 10, as by a net, line, weed, or other impediment to propeller rotation, blades 38 and 60 will be driven together. If the force of rotation of propeller either toward the top of the page or the bottom is thought of as a vertical vector having appropriate direction, and the axial force acting upon the shearing blades 38 and 60 is thought of as a horizontal vector of appropriate direction, the resultant force of the strut 12 on the protruding wedge 42 will be understood as the sum of such vectors. The position of the parts shown in FIG. 3 is of course prior to shaft rotation since the surfaces of cavity 44 are not abutting either side of strut 12. The space between the distal forward end of protruding member 44 and the strut 12 of the motor is provided to permit end play of propeller shaft when the vessel is underway.

As shown in FIG. 3, wedge cavity 44, in alternative embodiments, includes dampening means 45, which dampen both the impact and the sound caused by the contact of wedge cavity 44 upon strut 12. In the particular embodiment dampening means 45 are urethane plugs. However, any alternative dampening means which so lessens the contact and minimizes sound, could readily be incorporated in the invention.

Figures 5, 7A, 7B:
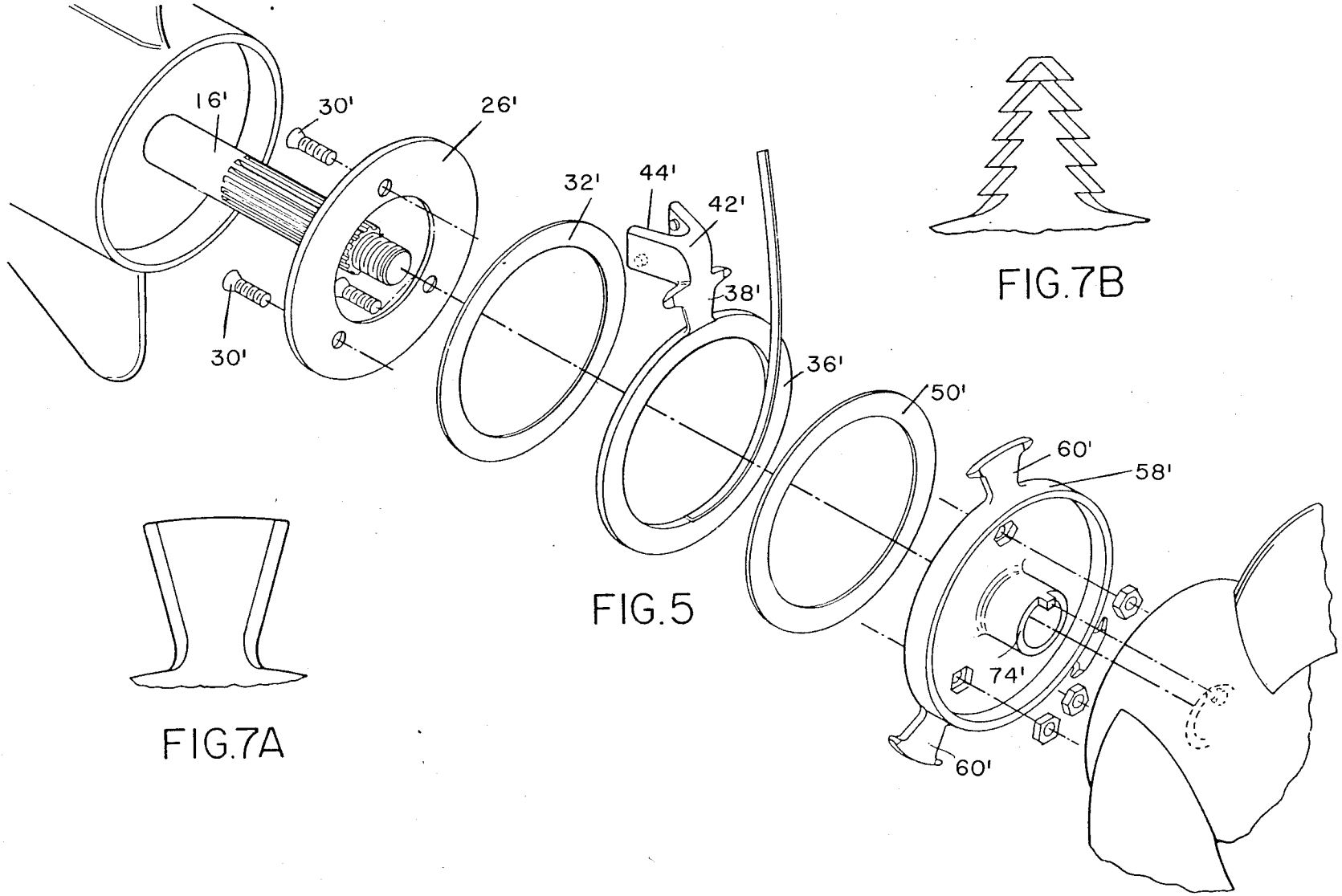
FIG. 5 is an alternative embodiment of an exploded isometric view of the invention installed on an outboard motor assembly.

Referring now to FIG. 5, a perspective view is shown depicting an alternative embodiment of the invention used on outboard motors. In this embodiment non-rotatable cutter ring 36′ is manufactured in accordance with the non-rotatable cutter ring 36 as discussed above. Rotatable cutter rings 58′ is shown having a plurality of cutting blades 60′. In this embodiment, rotatable cutter rings 58′ has an inner ring member 74′ which protrudes from both sides of cutter ring 58′. Inner ring member 74′ is centrally apertured in rotatable cutter ring 58′ and, in this embodiment, is of a continuous diameter. Inner ring 74′ is integrally formed with cutter ring 58′. The inner ring positions and stabilizes the cutter assembly about the propeller shaft.

At the propeller facing surface of inner ring member 74′, there exists an integrally formed key member 76. This key 76 acts in conjunction with a particular propeller such that it provides the drive means for imparting rotation to the cutter assembly. Key means 76 acts in a well known fashion with a corresponding void in the propeller such that rotation of the propeller imparts rotation to the cutter assembly. Inner ring member 74′ can be dimensioned to accommodate the structure of any particular propeller desired.

The assembly of the cutter apparatus as described in this embodiment, and its placement relative to the propeller assembly and propeller, is similar to that described above in reference to FIG. 1.

Figures 6, 7C, 7D:
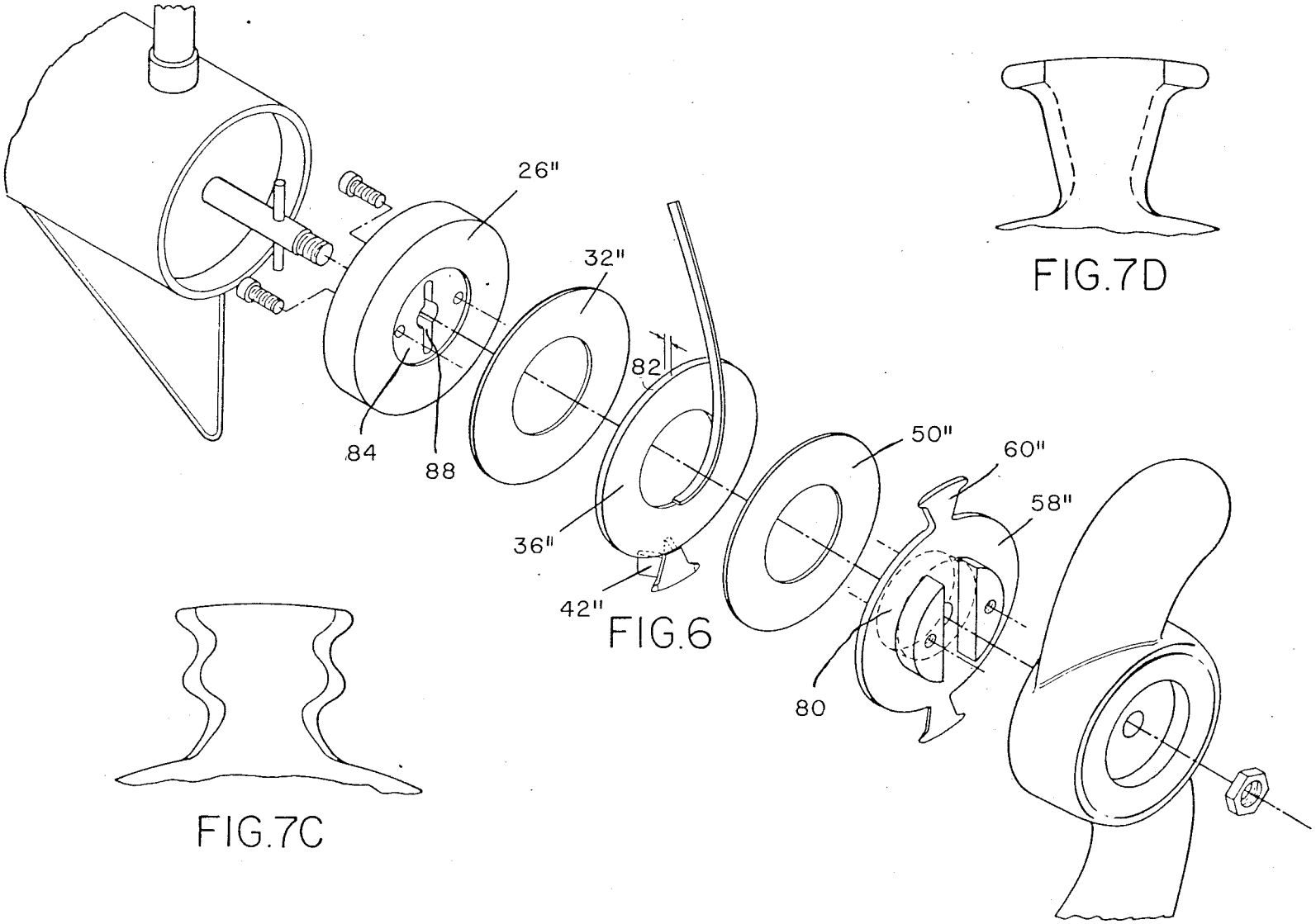
FIG. 6 is an alternative embodiment of an exploded isometric view of the invention installed on a trolling motor assembly.

Referring now to FIG. 6, a perspective view illustrates the application of the present invention upon trolling motors. In this embodiment rotatable cutter ring 58″ is shown to have a forwardly extending ledge member 80 which is dimensioned to have a width greater than the corresponding width 82 of non-rotatable cutter ring 36″. Bolt ring 26″ is configured to have a recessed central area 84 which is dimensioned to be greater in diameter than the outside diameter of ledge member 80, such that the ledge member 80 can house non-rotatable cutter ring 36″ and protrude into the recessed area 84 of bolt ring 26″, and provide a snug fit therefore. Bolt ring area 84 is also shown having a void 88 which defines a slotted keyway. This keyway receives the shaft and pin of a propeller shaft. The propeller shaft and pin thus provides the drive means for imparting rotation to the cutter assembly illustrated in this embodiment. In an alternative embodiment, the slotted keyway could also extend through and into the rotatable cutter ring 58″, in order to accommodate the corresponding shaft and pin slot of a particular propeller shaft.

Referring now to FIG. 7, a plurality of alternative shear edges are illustrated for the blade members 38 and 60. As illustrated, any given design of shear edges can be incorporated into this invention. FIG. 7A illustrates the conventionally defined pair of shear cutting edges, similar to a straight razor's edge. FIG. 7B illustrates a pair of shear edges, each edge having a serrated edge. FIG. 7C illustrates cutting edges having a curved structure thereon.

It is to be understood, and within the present invention, that any particular geometry of the cutting edge can be incorporated in the invention, and is simply a matter of design choice.

Finally, in FIG. 7D a cutting edge member 38 and 60 are illustrated having ramp like portions 39 and 40. These ramp-like portions can be incorporated into blades of any given geometry.

It should be noted that the cutter assemblies described above can be manufactured of a plastic or metal material, or alternatively with any material suitable for marine conditions.

While there have been described above the principles of this invention in conjunction with specific apparatus, it is to be clearly understood that this description is made only by way of example and not as a limitation to the scope of the invention. It is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention, which as a matter of language, might be said to fall between.

What is claimed is:

1. An apparatus that cuts lines, nets, and weeds of the type that may be encountered by propeller driven vessels utilizing outboard, inboard/outboard, or trolling motors, said vessels of the type where the propeller is mounted about a rotatable propeller shaft that extends rearwardly from a propeller shaft housing that depends to a vessel's hull, comprising:

an annular cutter ring disposed transversely to said propeller shaft, said cutter ring capable of limited movement relative to said propeller shaft housing, a cutting blade member mounted on said cutter ring, a pair of shear edges formed on opposite sides of said cutting blade member;

a protruding forwardly expanding, wedge member formed on said cutting blade member, said wedge member configured to define a forwardly opening wedge-shaped cavity, said wedge-shaped cavity adapted to receive said propeller shaft housing;

a rotatably mounted annular bolt ring disposed intermediate said cutter ring and said propeller shaft housing;

a rotatably mounted annular cutter ring mounted rearwardly of said non-rotatably mounted cutter ring so that said non-rotating cutter ring is disposed in sandwiched relation to said bolt ring and said rotatable cutter ring;

a plurality of circumferentially spaced cutting blade members mounted on said rotatable cutter ring;

a pair of shear edges formed on opposite sides of each of said plurality of cutting blade members;

said protruding wedge member entering into abutting engagement with said propeller shaft housing attendant rotation of said propeller shaft;

said propeller shaft housing entering into fine engagement with said forwardly opening wedge-shaped cavity substantially instantaneously upon the introduction of a load on said apparatus.

2. The apparatus of claim 1, further comprising:

a drive means, said drive means being mechanically connected to said propeller, whereby rotation of said propeller imparts rotation to said apparatus.

3. The apparatus of claim 1, further comprising:

a drive means, said drive means being mechanically connected to said propeller shaft, whereby rotation of said propeller shaft imparts rotation to said apparatus.

4. The apparatus of claim 1, further comprising:

a forwardly extending annular ledge member formed on said rotatable cutter ring;

said ledge member having an outside diameter less than the inside diameter of said non-rotatable cutter ring;

a strip of bearing material disposed in overlying relation to said ledge member;

said non-rotating cutter ring having an inside diameter sufficient to snugly receive therein said ledge member and said bearing material;

said ledge member maintaining said non-rotating cutter ring in its correct operative alignment with said rotatable cutter ring and said bolt ring.

5. The apparatus of claim 1, wherein:

said wedge-shaped cavity defines an angle which is approximately thirty (30) degrees.

6. The apparatus of claim 1, wherein:

the spacing between the rotatable and non-rotatable cutting blade members is between eight thousandths and fifteen thousandths of an inch (0.008"–0.015") when the apparatus is operating in a substantial absence of a resistive load thereon.

7. The apparatus of claim 5, wherein:

the rotatable and non-rotatable cutting blade members are driven together substantially instantaneously responsive to the introduction of a resistive load thereon.

8. The apparatus of claim 1, said apparatus positioned between the rearmost surface of said propeller shaft housing and the forwardmost surface of a propeller hub, thereby occupying and closing the space otherwise existing therebetween and thereby preventing the entry of lines and other articles from entering into said space and cutting oil seals and the like.

9. The apparatus of claim 1, further comprising:

said propeller shaft having a taper form therein, a centrally apertured inner ring member of reduced diameter formed as a part of said rotatable cutter ring, said central aperture configured in the form of a taper that corresponds to the taper formed in the propeller shaft, and said taper formed in said central aperture of said inner ring being driven onto the taper formed in the propeller shaft with attendant tightening of said propeller onto said propeller shaft by a mount nut.

10. The apparatus of claim 9, further comprising:

said inner ring member lying in a vertical plane forwardly of the plane of said rotatable cutter ring member;

a plurality of radial leg members interconnecting said inner ring member and said rotatable cutter ring member;

a propeller hub having a taper formed therein, and a taper formed on the rearward side of said rotatable cutter ring that corresponds to the taper formed on said propeller hub, said hub taper and said cutter ring taper disposed in spaced relation to one another.

11. The apparatus of claim 1, further comprising:

first bearing means interposed said annular bolt ring and said non-rotatable annular cutter ring, and second bearing means interposed said non-rotatable annular cutter ring and said rotatable cutter ring.

12. The apparatus of claim 11, wherein:

said first and second bearing means are formed of ceramic.

13. The apparatus of claim 11, wherein:

said first and second bearing means are formed of alumina ceramic.

14. The apparatus of claim 4, further comprising:

a plurality of circumferentially spaced aperture members formed in said annular bolt ring, a plurality of circumferentially spaced aperture members formed in said rotatable cutter ring, and a plurality of bolt members adapted to secure said annular bolt ring to said rotatable cutter ring.

15. The apparatus of claim 9, further comprising:

an aperture member formed in said inner ring member reduced diameter, a locator pin member, and a member formed in a propeller hub, said locator pin member extending through said inner ring member aperture and into said hub member to position the blades of said rotatable cutter ring relative to the propeller blades and to provide a means whereby damage to the driven assembly of the vessel can be avoided.

16. The apparatus of claim 15, further comprising:

a plurality of circumferentially spaced aperture members formed in said inner ring member of reduced diameter, a plurality of locator pin members, a pluality of bore members formed in the propeller hub, said locator pin members extending through said inner ring member apertures and into said hub bore members to position the blades in said rotatable cutter ring relative to the propeller blades and to provide a shearing means whereby damage to the driven assembly of the vessel can be avoided.

17. The apparatus of claim 1, wherein:

said propeller includes a propeller hub, and defines a one-inch (1″) void to accommodate the apparatus within a propeller cowling.

18. The apparatus of claim 1, further comprising:

said rotatable cutter ring having a centrally apertured inner ring member of continuous diameter formed as part of said cutter ring, said inner ring member protruding axially from said cutter ring, said inner ring member dimensioned to position, and stabilize, said apparatus about said propeller shaft, and drive means mechanically connected to said propeller, whereby rotation of said propeller imparts rotation to said apparatus.

19. The apparatus of claim 18 wherein said drive means is a key circumferentially positioned about the propeller facing edge of said inner ring member, said key communicating with said propeller, whereby rotation of said propeller imparts rotation to said apparatus.

20. The apparatus of claim 4, which further comprises:

said forwardly extending ledge member width dimensioned to be greater than the width of said non-rotatable cutter ring, said bolt ring having a recessed central area dimensioned to be greater in diameter than the outside diameter of said ledge member, said bolt ring snugly receiving a portion of said ledge member, said non-rotatable cutter ring in sandwiched relation interposed said rotatable cutter ring and said bolt ring, said bolt ring having a void defining a slotted keyway, said slotted keyway receiving the shaft and pin of said propeller shaft thereby providing the drive means for said apparatus.

21. The apparatus of claim 20 which further comprises:

said rotatable cutter ring having a means for positioning said propeller in interlocking relationship to said rotatable cutter ring.

22. The apparatus of claim 1 further comprising:

said non-rotatable blade member and said rotatable blade members provided with ramp-like portions on the respective distal ends thereof;

said ramp-like portions projecting outwardly in the plane of rotation of said rotatable blades, from a main body portion of each of said respective blade members so that the respective main body portions of such blades will cooperate with one another to achieve a shearing action in the absence of jamming, even when such blades are worn.

23. The apparatus of claim 1, further comprising:

as abutting engagement between said wedge-shaped cavity and said propeller shaft housing creates impact and sound, means for damping said impact and sound.

24. The apparatus of claim 23, wherein:

said means for dampening comprises urethane plugs positioned within said cavity.

25. The apparatus of claim 1, wherein:

said apparatus is manufactured from metal.

26. The apparatus of claim 1, wherein:

said apparatus is manufactured from plastic.

* * * * *